US005318007A

United States Patent [19]

Afshar

[11] Patent Number: 5,318,007

[45] Date of Patent: Jun. 7, 1994

[54] HEAT EXCHANGER MANIFOLD FOR SWIMMING POOL OR SPA HEATERS

[75] Inventor: Mohammad R. Afshar, Diamond Bar, Calif.

[73] Assignee: Hydrotech Chemical Corporation, City of Industry, Calif.

[21] Appl. No.: 54,708

[22] Filed: Apr. 28, 1993

Related U.S. Application Data

[63] Continuation of Ser. No. 758,626, Sep. 12, 1991, abandoned.

[51] Int. Cl.[5] ..... F24H 1/00

[52] U.S. Cl. ..... 126/350 R; 126/344; 165/135; 165/176

[58] Field of Search ..... 126/350 R, 93, 85 R, 126/351, 344; 122/14, 18, 19, 367.3, 235.15, 235.11, 257, 262, 275, 236; 165/135, 176, 174, 178, 173, 175

[56] References Cited

U.S. PATENT DOCUMENTS

| | | | |
|---|---|---|---|
| 320,635 | 6/1885 | Daudt | 122/275 |
| 3,407,805 | 10/1968 | Bougard | 126/350 R X |
| 3,741,169 | 6/1973 | Johnson | 122/367.3 |
| 3,800,748 | 4/1974 | Schindler et al. | 122/367.3 |
| 4,344,386 | 8/1982 | Black | 126/350 R |
| 4,561,421 | 12/1985 | Hwang et al. | 126/110 R |
| 4,738,225 | 4/1988 | Joang | 122/367.3 |

FOREIGN PATENT DOCUMENTS

| | | | |
|---|---|---|---|
| 2441706 | 3/1975 | Fed. Rep. of Germany | 122/367.3 |

*Primary Examiner*—Carl D. Price

*Attorney, Agent, or Firm*—Woodard, Emhardt, Naughton, Moriarty & McNett

[57] ABSTRACT

A swimming pool or spa heater unit having a heat exchanger manifold designed to permit the use of direct plastic piping connections to the manifold header. The manifold is principally characterized by a header end having an inlet port and outlet port located on a level below the manifold inlets and outlets communicating with the heat exchanger. The inverted arrangement of the header ports relative to the manifold inlets and outlets to the heat exchanger permits unreturned water in the unit heated by residual heat from the heater to form a temperature gradient therebetween which prevents the temperature of the water at the header connection from reaching a level incompatible with the use of direct plastic piping connections. The manifold is also integrally provided with weirs which serve to provide dry-fire protection for the heater.

4 Claims, 11 Drawing Sheets

HEAT EXCHANGER MANIFOLD FOR SWIMMING POOL OR SPA HEATERS

This application is a continuation of application Ser. No. 07/758,626, filed Sep. 12, 1991, abandoned.

BACKGROUND OF THE INVENTION

1. Field of the Invention

The present invention relates generally to liquid heaters and particularly swimming pool and spa heaters which transfer heat from products of combustion to water as it is being circulated through a heat exchanger.

2. Description of the Prior Art

A constant problem associated with the operation of conventionally known swimming pool and spa heaters is that after the heater is shut off, water circulation through the heater is also shut off and water left in the heat exchanger inside the unit continues to be heated by residual heat stored in the mass of the unit. The amount of this residual heat is quite often sufficient to cause the temperature of the remaining water in the heat exchanger to rise close to the boiling point before the heat can be dissipated to a point where the water temperature will begin to lower. Because the residual water in the heater can reach much higher temperatures than does the circulating heated water as it is returned to the swimming pool or spa, the last several feet of piping leading to the header of the heater unit on conventionally known heaters and the header couplings are made of copper or other high temperature piping material providing heat resistance characteristics sufficient to address the problem. This is a disadvantage because the use of plastic piping and couplings would offer significant manufacturing cost savings. Additionally, the high header temperatures place undesirable space restrictions on the location of the heater unit.

Another problem associated with such heaters is that they are often elevated above the level of the body of water in the swimming pool or spa. If a leak occurs in the water conduit system associated with the heater, the water in the heater will automatically drain and leave the heater dry. If the heater is fired while dry, a "dry-fire" will occur which may cause a melt-down of the heat exchanger before any of the typical safety controls in the heater are able to respond. A common practice which has been employed to address this problem is to incorporate a water trap through an extension to the heat exchanger or manifold which prevents the water from completely draining under such circumstances. If a "dry-fire" occurs in a heater having such a trap, the liquid trapped in the manifold or heat exchanger will rapidly convert into steam, the presence of which will more quickly activate the heater safety controls to shut down the heater.

SUMMARY OF THE INVENTION

In one aspect of the present invention there is provided a swimming pool or spa heater having a burner, an insulated combustion chamber above the burner, a heat exchanger above the insulated combustion chamber for facilitating heat transfer between heated air in the insulated combustion chamber and a liquid contained in the heat exchanger, a means for ventilating excess heat from the insulated combustion chamber, a heat exchanger manifold including at one end a plurality of inlets and outlets in fluid communication with the liquid in the heat exchanger and at the other end a header having an inlet port and an outlet port, and inlet and outlet water conduit including coupling means for coupling the water conduits to the header. The improvement is characterized by the inlet port and outlet port of the heat exchanger manifold header being positioned on a level below the plurality of heat exchanger manifold inlets and outlets, thereby allowing the portions of the water conduits located adjacent the header to be made of plastic.

In another aspect of the present invention, the improvement is characterized by the inlet port and outlet port of the header being positioned on a level no higher than the plurality of heat exchanger manifold inlets and outlets and the manifold further integrally including weir means, associated with the plurality of heat exchanger manifold inlets and outlets, for limiting the flow of water from the heat exchanger between the plurality of heat exchanger manifold inlets and outlets and the inlet port and outlet port of the header.

It is an object of the present invention to provide a swimming pool or spa heater having a heat exchanger manifold of improved design which permits the use of direct plastic piping connections to the manifold header.

It is a further object of the present invention to provide a swimming pool or spa heater with a heat exchanger manifold having integrally formed weir means providing "dry-fire" protection for the heater.

Related objects and advantages of the present invention will become more apparent by reference to the following figures and detailed description.

DESCRIPTION OF THE PREFERRED EMBODIMENT

Figure 1:
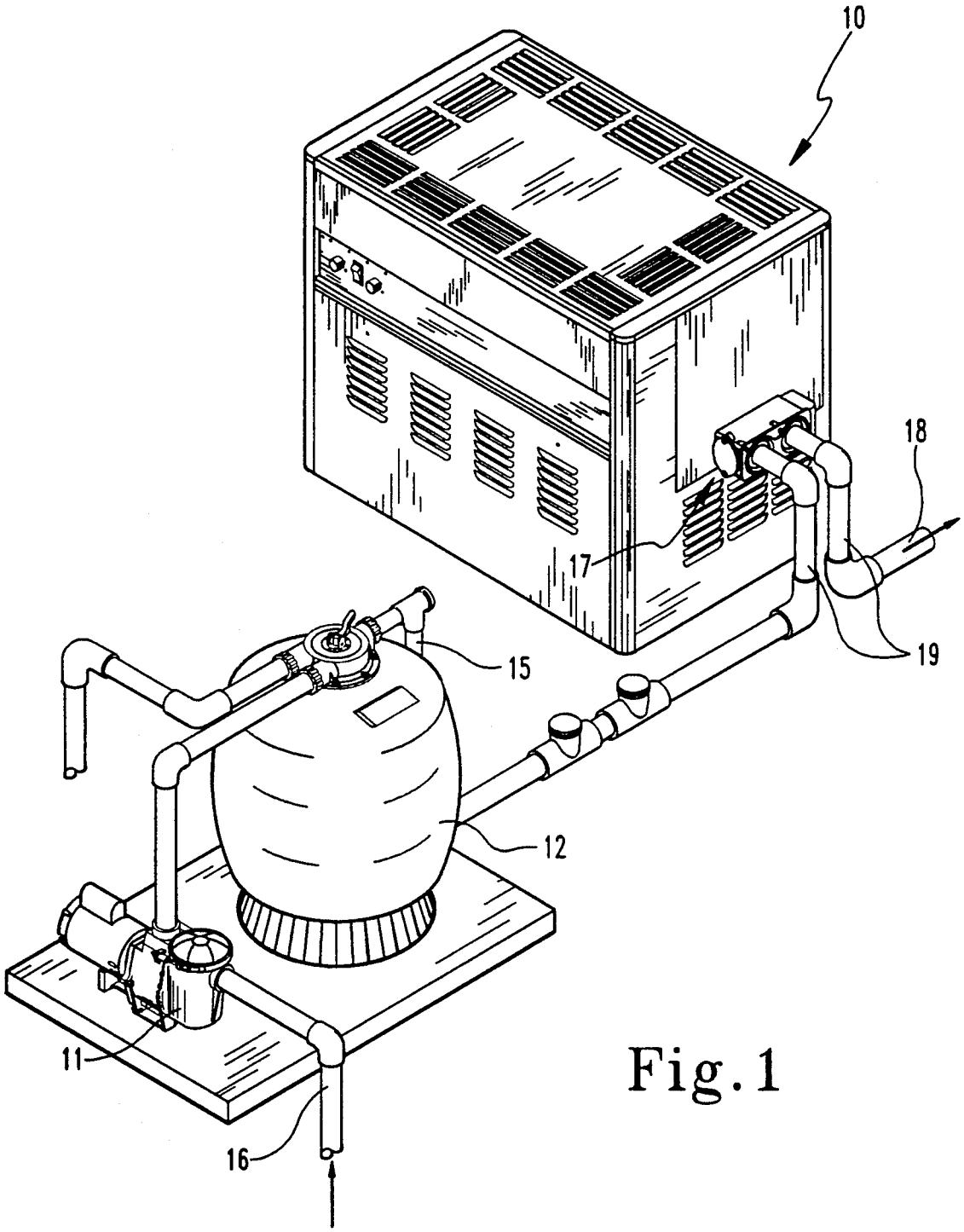
FIG. 1 is a perspective view showing the swimming pool or spa heater of the present invention connected to a conventional pump and filter and showing the piping connections to and from a pool or spa.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to the drawings in detail, FIG. 1 shows the swimming pool or spa heater of the present invention generally designated at 10 connected to a conventional pump 11 and filter unit 12. Heater 10 is connected at a header coupling 13 to a piping conduit 15 which routes to filter unit 12. Water from the pool or spa (not shown) enters pump 11 from piping conduit 16 and after being filtered through filter unit 12 is circulated into heater 10 through conduit 15. After being heated by heater 10 the heated water exits at header coupling 17 and returns to the swimming pool or spa through piping conduit 18. The pump 11, filter unit 12, and piping connections just described are conventionally well known and it should be understood that the depiction and arrangement of these components is representational only. It should however be appreciated that whereas polyvinylchloride (PVC) plastic piping is now commonly used for most of the various piping connections just described, for reasons previously discussed the last several feet of piping leading to header coupling 16 and first several feet of piping leading from header coupling 15 generally designated at arrow 19 have in the past necessarily employed high temperature piping such as copper piping. In the present invention, piping segments 19 may be made of PVC piping or other plastic piping which cannot withstand water temperatures approaching the boiling point.

Figure 2:
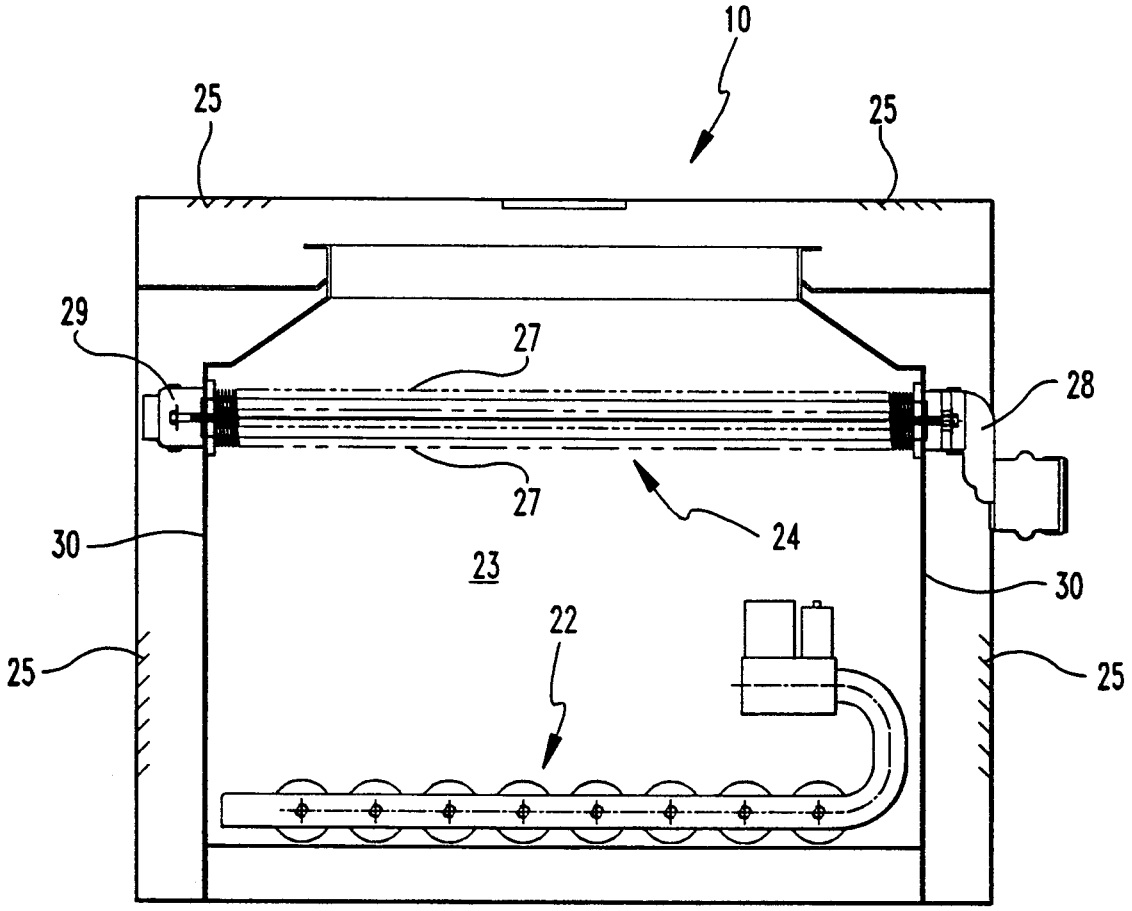
FIG. 2 is a diagrammatic view showing internal features of the pool or spa heater of FIG. 1.
Figure 3:
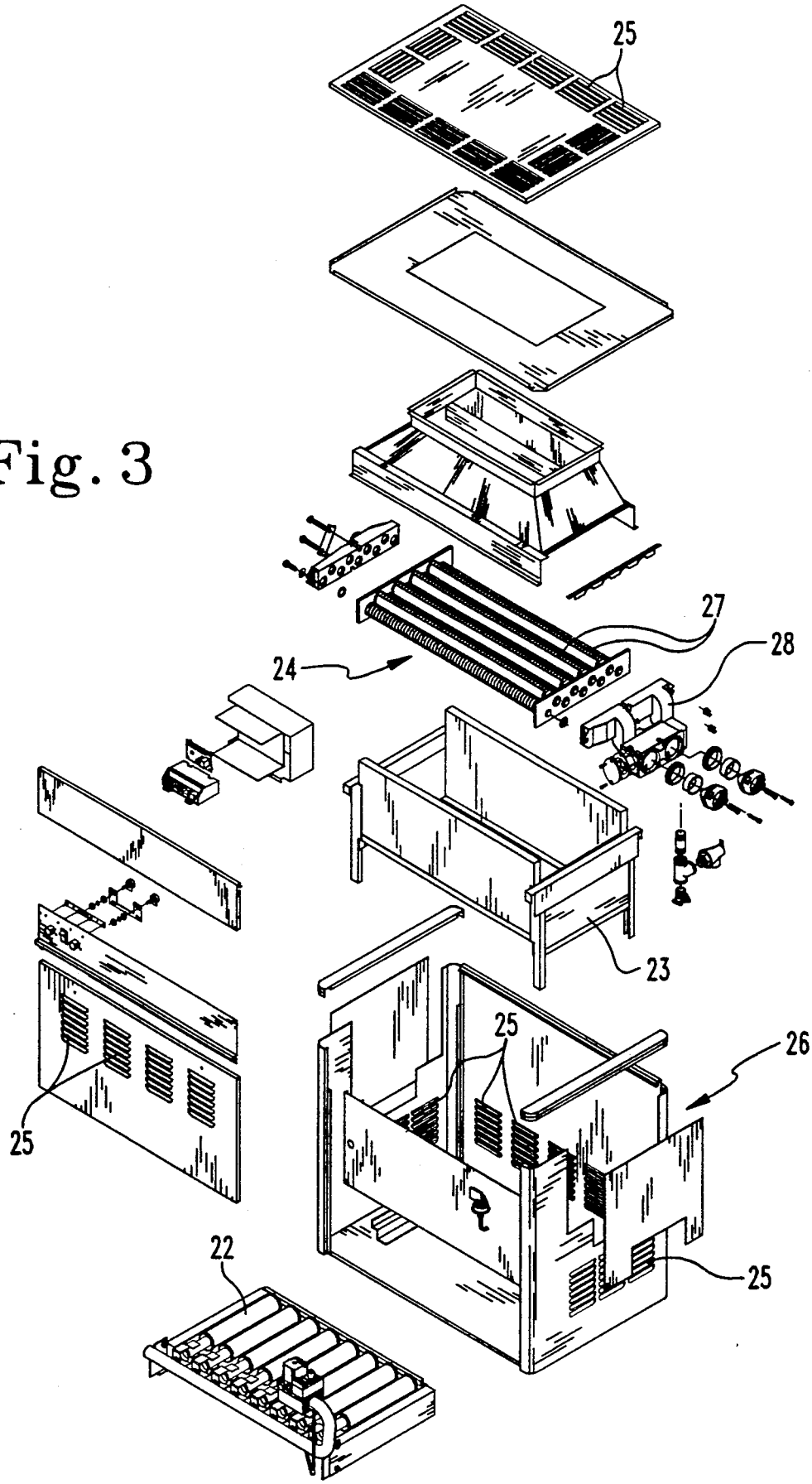
FIG. 3 is an exploded perspective view showing various components of the pool or spa heater of FIG. 1.
Figure 4:
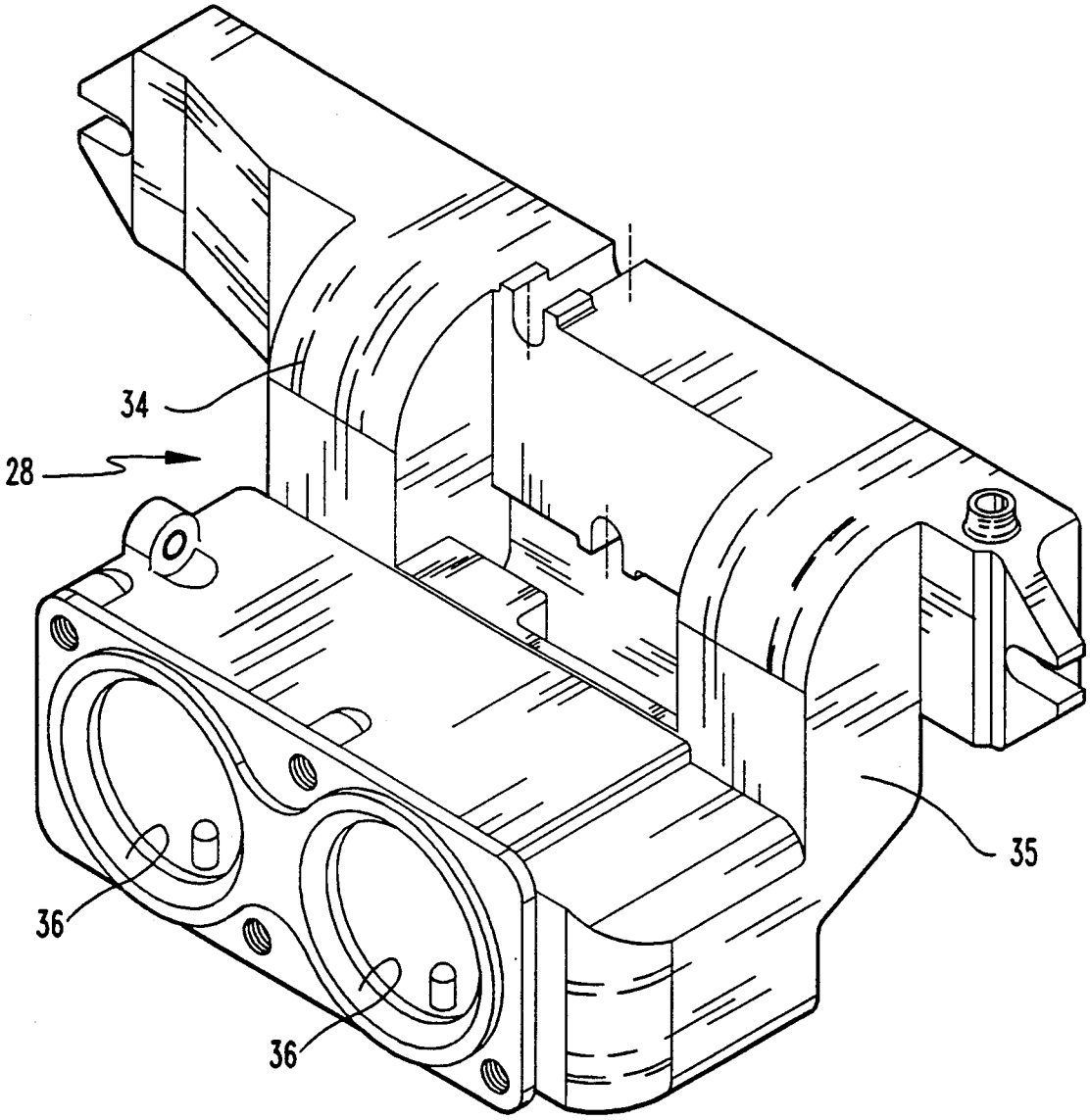
FIG. 4 is a perspective view, looking from the right-front side, of the heat exchanger manifold.

Referring now to FIGS. 2 and 3, the heater 10 generally includes a gas-type burner 22 mounted in the lower portion of a combustion chamber 23, a heat exchanger 24 comprising a plurality of parallel mounted tubes 27 extending horizontally within combustion chamber 23 above burner 22, and an air ventilation system including a plurality of louvres 25 formed in the top, front, rear and side walls of housing 26 and openings in the combustion chamber 23. As seen in FIG. 3, there are a series of nine heat exchanger tubes in the preferred embodiment. Depending upon various design considerations such as the desired heating capacity of the heater, size and length of the tubes, etc., the number of tubes may of course be varied. The walls of combustion chamber 23 are wrapped with a suitable insulation material 30. Heat exchanger 24 extends between and is in fluid communication with a manifold 28 and return header 29.

Figure 5:
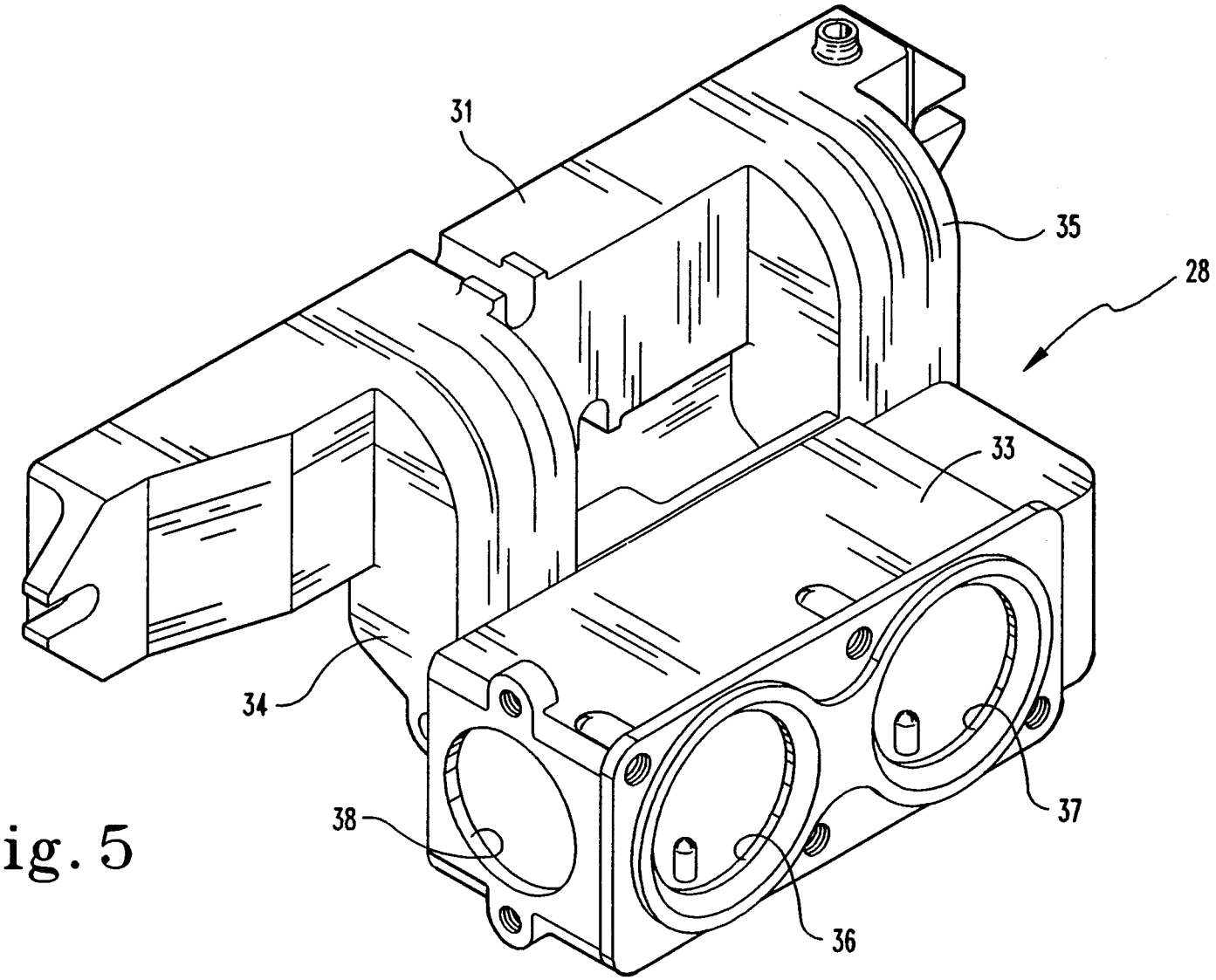
FIG. 5 is a perspective view, looking from the left-front side, of the heat exchanger manifold of FIG. 4.
Figure 6:
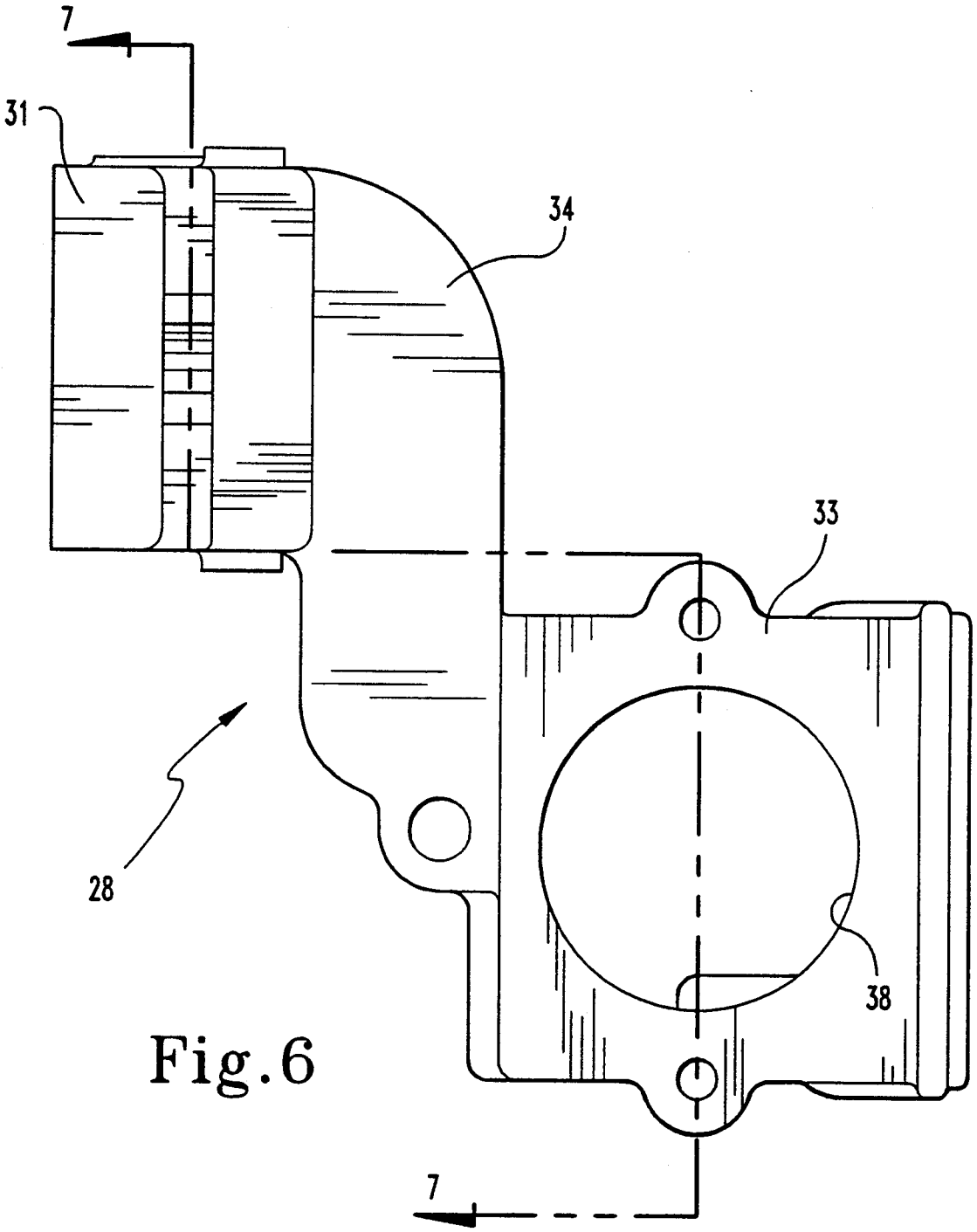
FIG. 6 is a left side elevation view of the heat exchanger manifold of FIG. 4.
Figure 7:
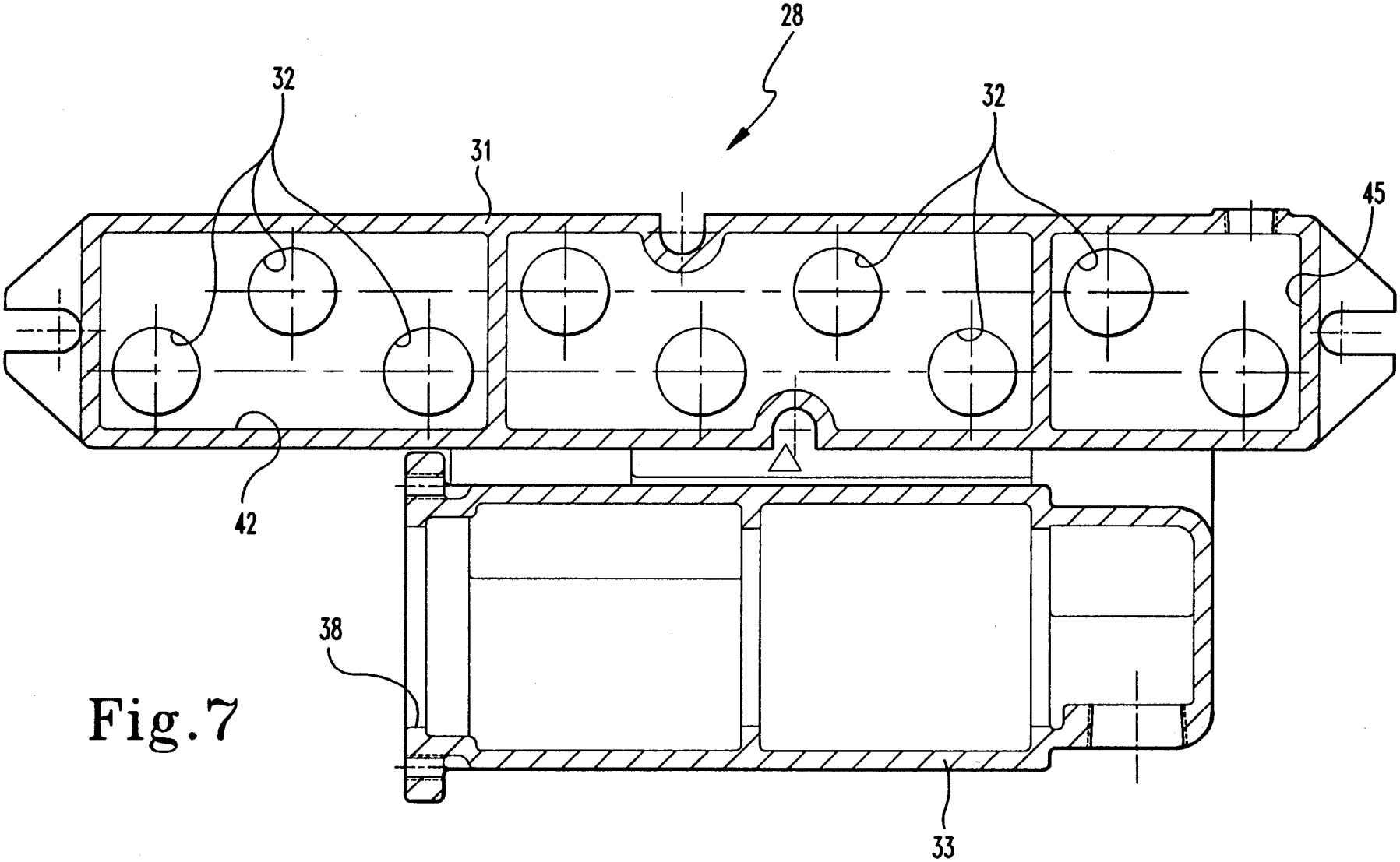
FIG. 7 is a section view taken along lines 7—7 in FIG. 6.
Figure 8:
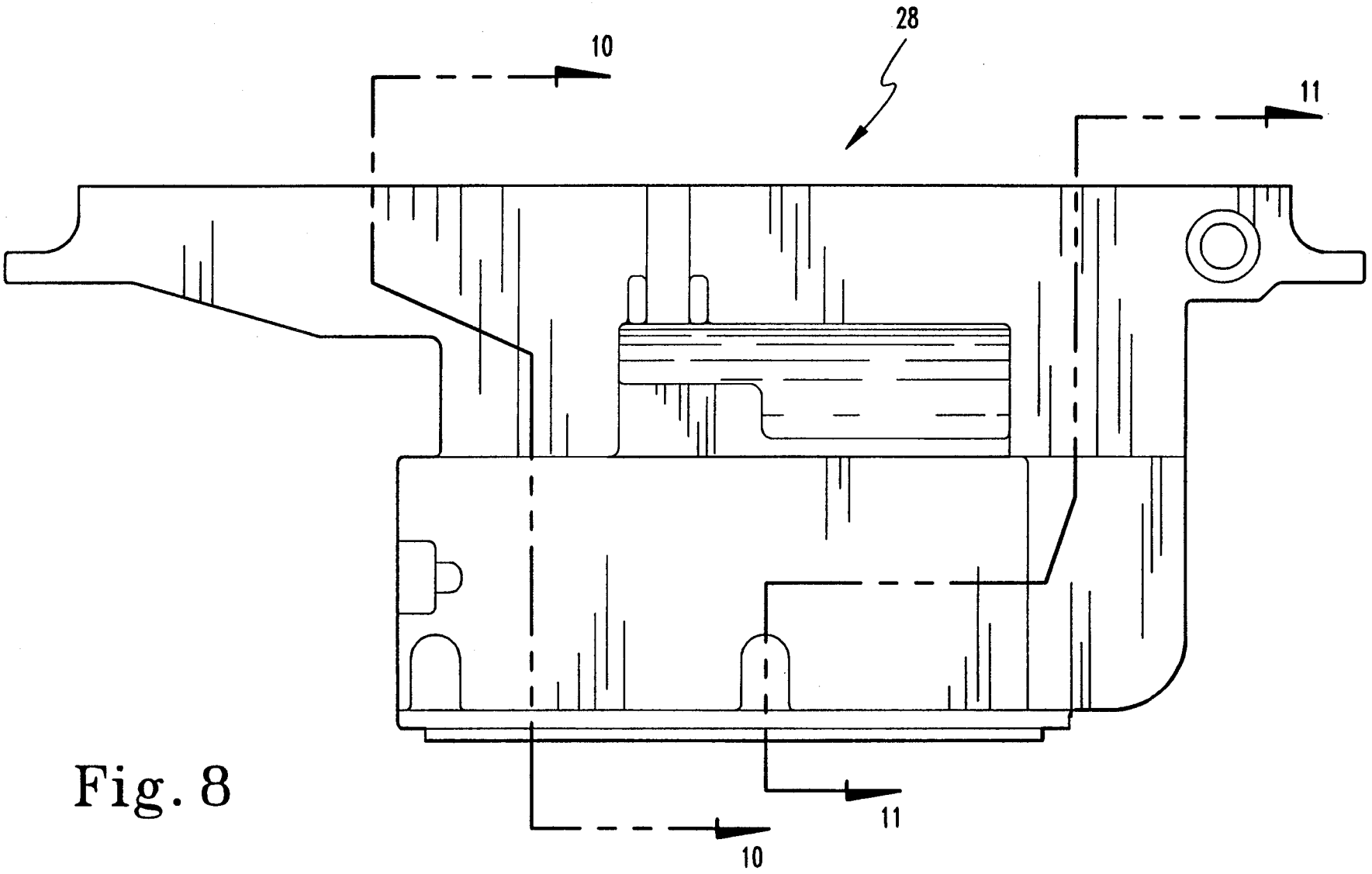
FIG. 8 is a top elevation view of the heat exchanger manifold of FIG. 4.

Referring now to FIGS. 4–12, the construction of manifold 28 will now be described in detail. At the heat exchanger end 31 of the manifold 28 there is provided a plurality of heat exchanger inlets and outlets 32 having identical diameters and which correspond in number with the desired number of heat exchanger tubes 27. While the preferred embodiment is shown as having a total of nine inlets and outlets 32, a greater or lesser number could also be employed. In order to provide desirable air flow between the tubes 27 while conserving space, the tubes, and accordingly also the inlets and outlets 32, are arranged in two axially horizontally aligned rows with the respective inlets and outlets of each row being offset relative to one another. At the other end of manifold 28 is a header 33 defining a header inlet 36 and header outlet 37. The diameters of the header inlet 36 and header outlet 37 are identically sized and the centers thereof are axially aligned horizontally. Webs 34 and 35 define channels which respectively interconnect the three leftmost inlets/outlets 32 and two right most inlets/outlets 32 in FIG. 7 to header inlet 36 and header outlet 37. The central four inlets/outlets 32 in FIG. 7 provide an intermediate return pass to return header 29. As seen in FIGS. 5 and 6, header 33 is also provided with an access opening 38 over which is mounted a thermal and flow valve assembly (not shown).

The manifold 28 is preferably sized and arranged such that the average of water left standing in the heat exchanger when the heater is shut off will be no less than about 3 inches, and because of space restrictions in the heater 10 is preferably in a range from about 3 to 4 inches, above the average water level at the header inlet 36 and header outlet 37. This arrangement is inverted from the orientation of conventionally known manifolds which typically position the header inlet and outlet above the level of the heat exchanger. This amount of spacing provides a sufficiently high column of water that as the water left standing in the heater is heated by residual heat thermally stored in the mass of the heater, a temperature gradient will form along the height of the column which prevents water in the vicinity of the header inlet and outlet from reaching a temperature which could be destructive to the structural integrity of commonly used PVC piping. Because the heat exchanger 24 depicted herein is formed of a series of straight tubes, the average level of water in the heat exchanger will be identical to the average height of the centers of the inlets/outlets 32 and the average level of water at the header inlet and outlet will be identical to theheight of their centers.

Figure 9:
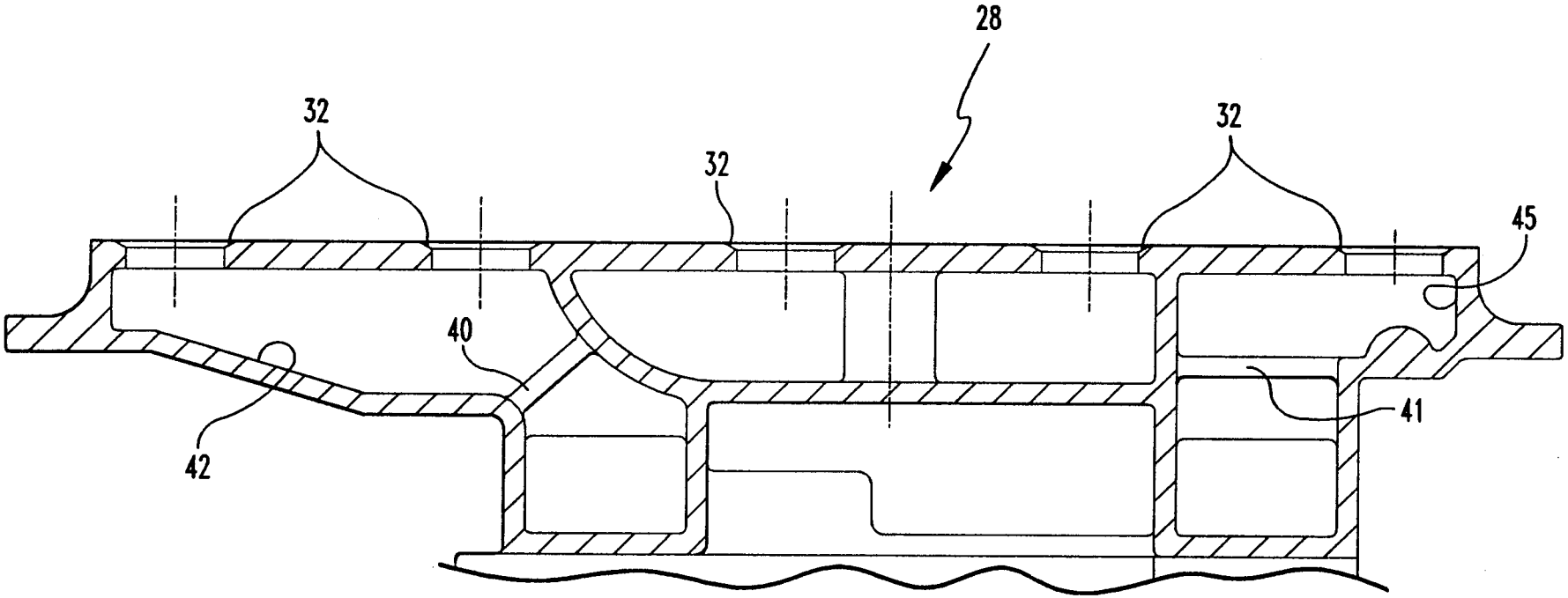
FIG. 9 is a fragmentary top elevation view, similar to FIG. 8, but shown partially in a section taken along the centerline of the top row of heat exchanger inlets and outlets so as to show internal features.
Figure 10:
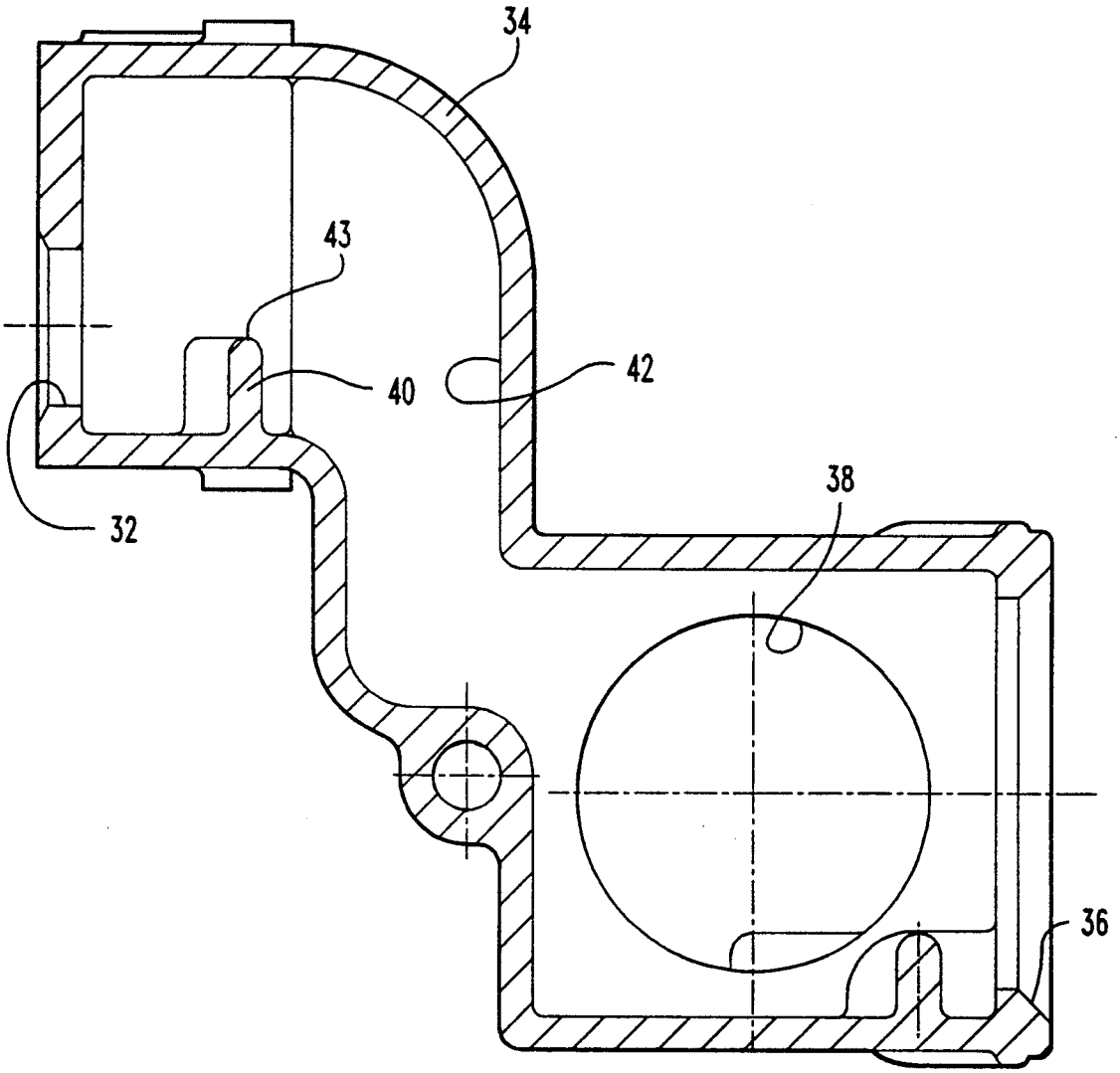
FIG. 10 is a section view taken along lines 10—10 in FIG. 8.
Figure 11:
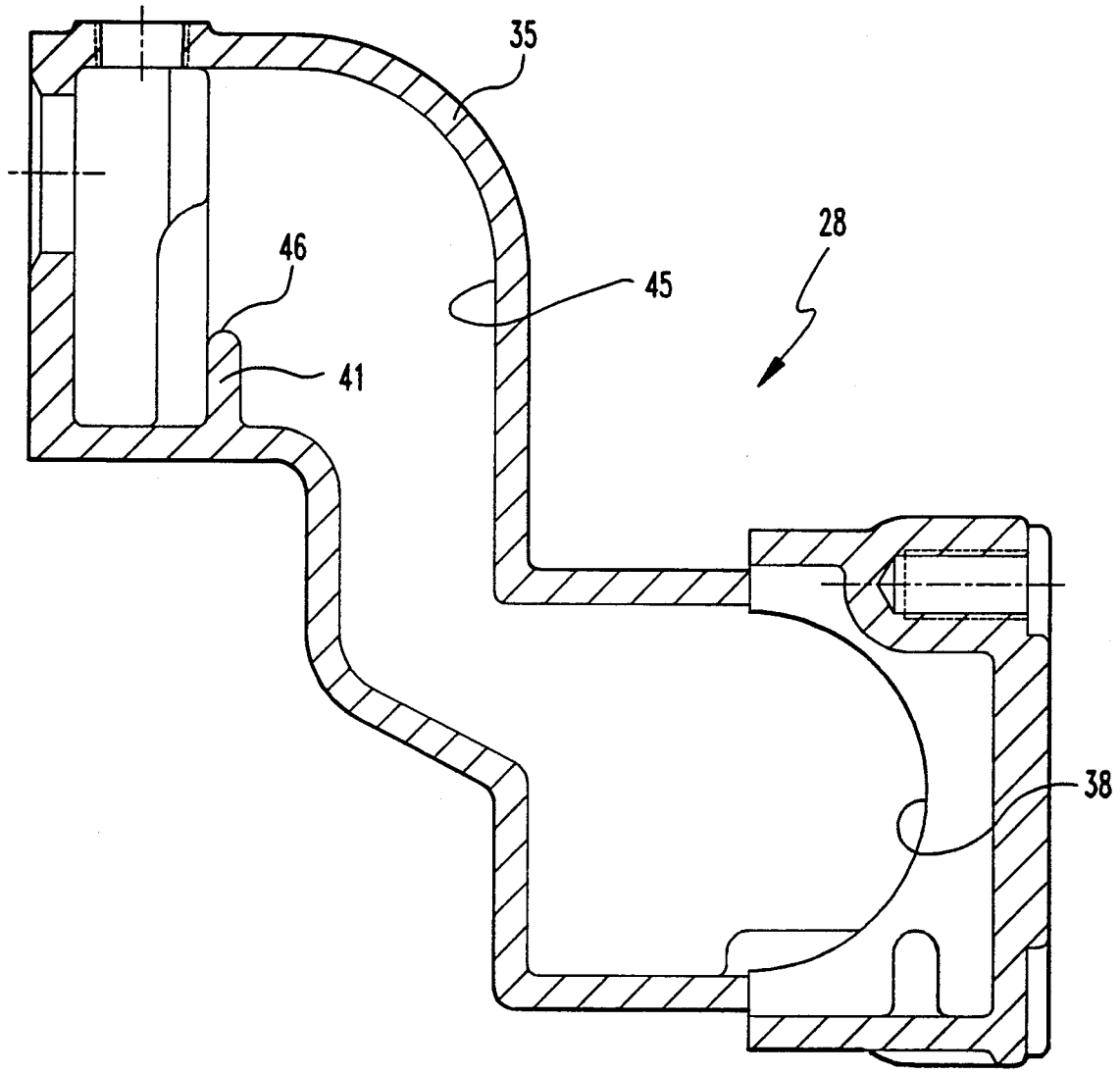
FIG. 11 is a section view taken along lines 11—11 in FIG. 8.

Referring now particularly to FIGS. 9–11, manifold 28 is integrally provided with weirs 40 and 41. The weir 40 extends in the fluid channel 42 communicating between the leftmost two outlets 32 shown in FIG. 9 as well as a third outlet 32 (see FIG. 7) not shown in FIG. 9 and header inlet 36 (see FIG. 5). As shown in FIGS. 9 and 10, weir 40 is positioned slightly behind the outlets 32 at a location where channel 42 has a constricted width, with the top 43 of weir 40 extending vertically to a height which is only slightly lower than the center of the lower outlets 32. Weir 41 is positioned in the fluid channel 45 extending between the two rightmost inlets 32 as seen in FIG. 7 (only one of which is shown in FIG. 9) and header outlet 37. Similar to weir 40, the top 46 (FIG. 10) of weir 41 extends vertically to a height which is only slightly lower than the center of the lower of the two inlets 32 in channel 45. Weirs 40 and 41 thus prevent water from completely draining from the heat exchanger tubes 27 in the event of a leak anywhere else in the system.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In a swimming pool or spa heater having a burner, an insulated combustion chamber above the burner, a heat exchanger above the insulated combustion chamber for facilitating heat transfer between heated air in the insulated combustion chamber and a liquid contained in the heat exchanger, a means for ventilating excess heat from the insulated combustion chamber, a heat exchanger manifold including at one end a plurality of inlets and outlets in fluid communication with the liquid in the heat exchanger, the heat exchanger manifold further including a header having an inlet port at a first end and an outlet port at a second end, and inlet and outlet water conduits including coupling means for coupling the water conduits to the header, the improvement comprising:

said heat exchanger having a first end which defines a top portion and a second end which defines a lower end wherein said inlet port and outlet port of the header of said heat exchanger manifold are below said plurality of heat exchanger manifold inlets and outlets in the direction of said lower end, wherein said heat exchanger manifold integrally includes a weir means, associated with said plurality of heat exchanger manifold inlets and outlets, for retaining a minimum amount of liquid in said heat exchanger between said plurality of heat exchanger manifold inlets and outlets and said inlet port and outlet port of said header.

2. In a swimming pool or spa heater having a burner, an insulated combustion chamber above the burner, a heat exchanger above the insulated combustion chamber for facilitating heat transfer between heated air in the insulated combustion chamber and a liquid contained in the heat exchanger, a means for ventilating excess heat from the insulated combustion chamber, a heat exchanger manifold including at one end a plurality of inlets and outlets in fluid communication with the liquid in the heat exchanger, the heat exchanger manifold further including a header having an inlet port at a first end and an outlet port at a second end, and inlet and outlet conduits including coupling means for coupling the conduits to the header, the improvement comprising:

said heat exchanger having a first end which defines a top portion and a second end which defines a lower end wherein said inlet port and outlet port of the header of said heat exchanger manifold are located on a level no higher than said plurality of heat exchanger manifold inlets and outlets in the direction of said lower end;

and said heat exchanger manifold integrally includes a weir means, associated with said plurality of heat exchanger manifold inlets and outlets, for retaining a minimum amount of liquid in said heat exchanger between said plurality of heat exchanger manifold inlets and outlets and said inlet port and outlet port of said header.

3. The improvement of claim 2 wherein said heat exchanger manifold inlets and outlets are arranged along upper and lower rows, said weir means having a top which extends to a level above the bottom of said lower row of heat exchanger manifold inlets and outlets.

4. The improvement of claim 2 wherein said heat exchanger manifold is arranged such that said inlet port and said outlet port of said header are each located on a level which is at least about three inches below the average level of said plurality of heat exchanger manifold inlets and outlets.

* * * * *

UNITED STATES PATENT AND TRADEMARK OFFICE

CERTIFICATE OF CORRECTION

PATENT NO. : 5,318,007

DATED : June 7, 1994

INVENTOR(S) : Mohammad R. Afshar

It is certified that error appears in the above-identified patent and that said Letters Patent is hereby corrected as shown below:

Column 2, line 2, "conduit" should read --conduits--.

Column 4, line 10, after "average" insert --level--.

Column 4, line 32, "theheight" should read --the height--.

Signed and Sealed this

Tenth Day of January, 1995

*Attest:*

*Attesting Officer*

Bruce Lehman

BRUCE LEHMAN

*Commissioner of Patents and Trademarks*